US007500463B2

(12) United States Patent
Shuba

(10) Patent No.: US 7,500,463 B2
(45) Date of Patent: Mar. 10, 2009

(54) SHUBA ROTARY INTERNAL COMBUSTION ENGINE WITH ROTATING COMBUSTION CHAMBERS

(76) Inventor: Yaroslav M. Shuba, Shota Rustaveli Street, 40, Apt. 16, Kyiv (UA) 01023

( * ) Notice: Subject to any disclaimer, the term of this patent is extended or adjusted under 35 U.S.C. 154(b) by 0 days.

(21) Appl. No.: 11/601,790

(22) Filed: Nov. 20, 2006

(65) Prior Publication Data

US 2008/0135012 A1 Jun. 12, 2008

(51) Int. Cl.

| | |
|---|---|
| ***F02B 53/00*** | (2006.01) |
| ***F02B 53/04*** | (2006.01) |
| ***F01C 1/00*** | (2006.01) |
| ***F01C 21/00*** | (2006.01) |
| ***F04C 18/00*** | (2006.01) |
| ***F04C 2/00*** | (2006.01) |
| ***F04C 15/00*** | (2006.01) |

(52) U.S. Cl. ..... 123/243; 123/248; 123/240; 123/229; 418/248; 418/186

(58) Field of Classification Search ..... 123/248, 123/240, 235, 237, 229; 418/186, 187, 188, 418/248

See application file for complete search history.

(56) References Cited

U.S. PATENT DOCUMENTS

| | | | | | |
|---|---|---|---|---|---|
| 749,654 | A | * | 1/1904 | Banta et al. | 123/229 |
| 811,117 | A | * | 1/1906 | Andrews | 418/212 |
| 868,374 | A | * | 10/1907 | Thomure | 418/186 |
| 1,145,161 | A | * | 7/1915 | Mears | 123/248 |
| 1,242,692 | A | * | 10/1917 | Hibner | 418/248 |
| 1,255,865 | A | | 2/1918 | Doane | |
| 1,257,156 | A | * | 2/1918 | Van Lith | 123/248 |
| 1,424,977 | A | * | 8/1922 | Bidwell | 123/231 |
| 1,427,053 | A | * | 8/1922 | Bidwell | 123/231 |
| 1,577,141 | A | * | 3/1926 | Morrison et al. | 123/243 |
| 1,792,026 | A | | 2/1931 | Nichols | |
| 1,811,729 | A | * | 6/1931 | Molkenbur | 123/229 |
| 1,923,561 | A | * | 8/1933 | Winckler | 123/240 |
| 2,511,441 | A | | 6/1950 | Loubiere | |
| 2,864,346 | A | * | 12/1958 | Taylor, Jr. | 123/243 |
| 2,988,065 | A | * | 6/1961 | Wankel et al. | 123/242 |
| 3,181,511 | A | * | 5/1965 | Johnson | 123/240 |
| 3,244,157 | A | * | 4/1966 | Tanferna et al. | 418/246 |
| 3,314,368 | A | * | 4/1967 | Drutchas et al. | 418/248 |
| 3,422,801 | A | * | 1/1969 | Mido | 123/229 |

(Continued)

FOREIGN PATENT DOCUMENTS

| | | | | |
|---|---|---|---|---|
| JP | 61241420 | A | * | 10/1986 |

*Primary Examiner*—Thai-Ba Trieu

(57) ABSTRACT

A rotary internal combustion engine has a hollow stator with inner cylindrical surface, and a right-prism rotor having rhombus-shape base with round angles and convex sides whose big diagonal equals the diameter of the stator. Two cavities within the rotor on opposite ends of the big diagonal of rhombus-shape base form principal combustion chambers with spark plugs. The hollow stator contains a diametrically opposed space separators sealingly engaged with the surface of the rotor. Variable volume intake, compression, power and exhaust chambers of the engine are formed by the inner surface of the stator, outer surface of the rotor and the side surfaces of the space separators. Intake and exhaust chambers are connected to the intake and exhaust systems via respective conduits. Compression and power chambers are connected to the combustion chambers via a slot openings controlled by the sliding covers moving within a radial rectangular grooves in the rotor.

3 Claims, 6 Drawing Sheets

U.S. PATENT DOCUMENTS 3,467,070 A * 9/1969 Green ..... 123/229
3,540,816 A * 11/1970 Alcolea ..... 418/177
3,837,323 A * 9/1974 Delfino et al. ..... 123/229
3,951,112 A 4/1976 Hunter
3,955,540 A 5/1976 Blanchard
3,960,117 A * 6/1976 Kammerer ..... 123/248
3,964,447 A 6/1976 Normandin
4,014,298 A * 3/1977 Schulz ..... 123/229
4,018,191 A 4/1977 Lloyd ..... 123/243
4,023,540 A * 5/1977 Zollenkopf ..... 123/240
4,422,419 A 12/1983 Umeda
4,515,123 A 5/1985 Taylor
4,667,468 A 5/1987 Hansen
4,848,296 A 7/1989 Lopez
5,277,158 A 1/1994 Pangman
5,423,297 A 6/1995 Roberts
6,070,565 A 6/2000 Miniere
6,247,443 B1 6/2001 Peleja
6,539,913 B1 4/2003 Gardiner
7,077,098 B2 7/2006 Shuba ..... 123/240

* cited by examiner

SHUBA ROTARY INTERNAL COMBUSTION ENGINE WITH ROTATING COMBUSTION CHAMBERS

CROSS-REFERENCE TO RELATED APPLICATIONS

Not Applicable

FEDERALLY SPONSORED RESEARCH

Not Applicable

SEQUENCE LISTING OR PROGRAM

Not Applicable

BACKGROUND OF THE INVENTION

1. Field of Invention

The invention relates to internal combustion engines, in particular to true rotary engines in which the energy of combusted gases directly drives rotation of the rotor and whose working members rotate around an axle fixed on a rotor.

2. Discussion of Prior Art

The drawbacks of a conventional internal combustion engine (CICE), in which reciprocal movements of the pistons are translated into rotation of a crankshaft via special transduction means, are well known. The major ones are: 1) low efficiency coefficient due to losses on friction of slide between pistons and cylinders walls and transduction of reciprocal-to-rotational motion; 2) excessive vibrations due to imbalances in the whole piston—transduction mechanism—crankshaft system; 3) big weight; 4) high fuel consumption; 5) necessity for many accessory mechanisms; 6) high environment-polluting propensity. Despite all these considerable drawbacks the CICE for over 100 years continues to be a dominant engine on most types of transportation and non-electrical motor-driven appliances. Moreover, it became the matter of wrongful prestige to bring to the forefront the number of cylinders, liters, valves and largely useless horse powers of such engine. The real alternative to the conventional reciprocal internal combustion engine is rotary internal combustion engine (RICE), in which the energy of expanding gasses directly drives the rotation of the shaft.

Many models of RICE have been proposed and patented. The search of the U.S. Patent Database with the patent's title words query "(((rotary AND internal) AND combustion) AND engine)" resulted in 876 hits, of which about 80% represent new technical solutions. The data on technical testing of the acting prototypes for the most patented RICE models is not available. However, it seems that limited or questionable benefits offered by existing technical solutions of the RICE so far do not justify mass production of any of them, and replacement of the CICE. Most existing models apparently suffer either from excessive complexity translatable into high weight and cost of production or do not provide notable gains in the efficiency coefficient due to inability to reduce leak of gasses among working members. The most advanced model of RICE in terms of industrial elaboration is Wankel engine. The rotor in this type of engine has three convex facets and rotates eccentrically within cylindrical stator with peritrochoidal inner surface. However, this model still suffers from problems in pressurization of the combustion chamber, insufficient durability of compression elements, poor fuel efficiency especially at low loads and enhanced emission of carbohydrates.

Most of the prior arts including authors own one (U.S. Pat. No. 7,077,098, NPC 123/240, July 2006) represent different variations of the vane-type RICE, in which the energy of combusted gasses drives rotation of the rotor via interaction with the vane(s) disposed on the rotor, as such configuration potentially provides the best conditions in terms of energy conversion efficiency. To create working chambers of variable volume required for performing gas compression and expansion cycles the prior arts took advantage of eccentric disposition of the rotor within cylindrical stator (U.S. Pat. No. 1,255,865, NPC 123/235, February 1918; U.S. Pat. No. 2,511,441, NPC 123/235, June 1950, U.S. Pat. No. 3,951,112, NPC 123/242, April 1976; U.S. Pat. No. 3,955,540, NPC 418/260, May 1976; U.S. Pat. No. 3,964,447, NPC 123/236, June 1976; U.S. Pat. No. 4,422,419, NPC 123/235, December 1983; U.S. Pat. No. 4,848,296, NPC 123/242, July 1989; U.S. Pat. No. 6,247,443, NPC 123/229, June 2001) or concentric disposition of the rotor within the stator having peritrochoid-lellipsoid-like (U.S. Pat. No. 4,018,191, NPC 123/243, April 1977; U.S. Pat. No. 4,667,468, NPC 123/248, May 1987; U.S. Pat. No. 5,277,158, NPC 123/243, January 1994; U.S. Pat. No. 6,539,913, NPC 123/231, April 2003) or specially shaped (U.S. Pat. No. 1,792,026, NPC 123/235, February 1931; U.S. Pat. No. 4,515,123, NPC 123/222, May 1985; U.S. Pat. No. 5,423,297, NPC 123/213, June, 1995;U.S. Pat. No. 6,070,565, NPC 123/231, June 2000) inner surface together with the vanes movable in radial slots within the rotor while sealingly engaged with the surface of the stator. The spark plug(s) required to ignite compressed air-fuel mixture in all prior arts is placed within the stator's body.

However in many types of vane-type rotary engines the structure is complex due to many components and tangled intrinsic system of gas conduits, and thus manufacturing costs may become high. The reliability and durability of gas sealing mechanisms in existing technical solutions also remains the matter of concern. Most engines also require valves and consequently the additional cumbersome systems for their operation. Thus, simple and yet reliable model of RICE that would attract manufactures attention still remains a priority.

SUMMARY

A very simple, but highly advantages four-cycle rotary internal combustion engine that includes a hollow stator with inner cylindrical surface, and a right-prism rotor having rhombus-shape base with round angles and convex sides whose big diagonal is the same as diameter of the stator is disclosed. Two cavities within the rotor made in the areas of sharp angles of rhombus-shape base form principal combustion chambers provided with spark plugs. The hollow cylindrical core of the stator contains two diametrically opposed radially arranged space separators sealingly engaged with the surface of the rotor. Variable volume intake, compression, power and exhaust chambers of the engine are formed by the inner surface of the stator, outer surface of the rotor and the side surfaces of the space separators. Intake and exhaust chambers are connected to the intake and exhaust systems via respective conduits within the stator. Compression and power chambers are connected to the combustion chambers via a slot openings controlled by the sliding covers moving within radial rectangular grooves in the rotor flanking combustion chambers.

BRIEF DESCRIPTION OF THE DRAWINGS

Various other objects, features and attendant advantages of the present invention will be more fully appreciated and the same becomes better understood from the following detailed description when considered in connection with the accompanying drawings in which like reference characters designate like or corresponding parts throughout the several views and wherein.

DETAILED DESCRIPTION OF THE INVENTION

Objects and Advantages

Figure 1:
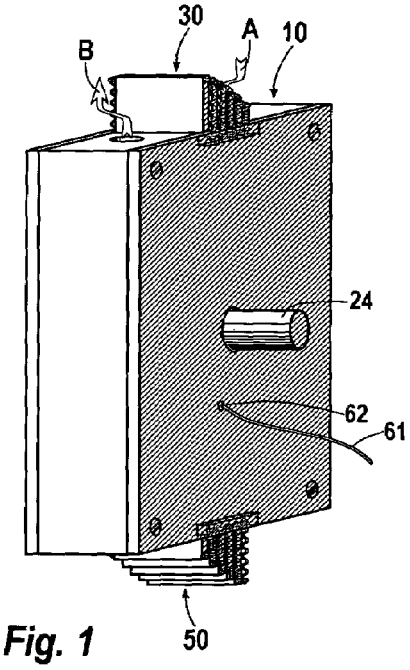
FIG. 1 shows a prospective view of the assembled engine of the present invention. The arrows A and B represent different gas flows as they are related to specific parts of the engine shown in this and other figures.
Figure 2:
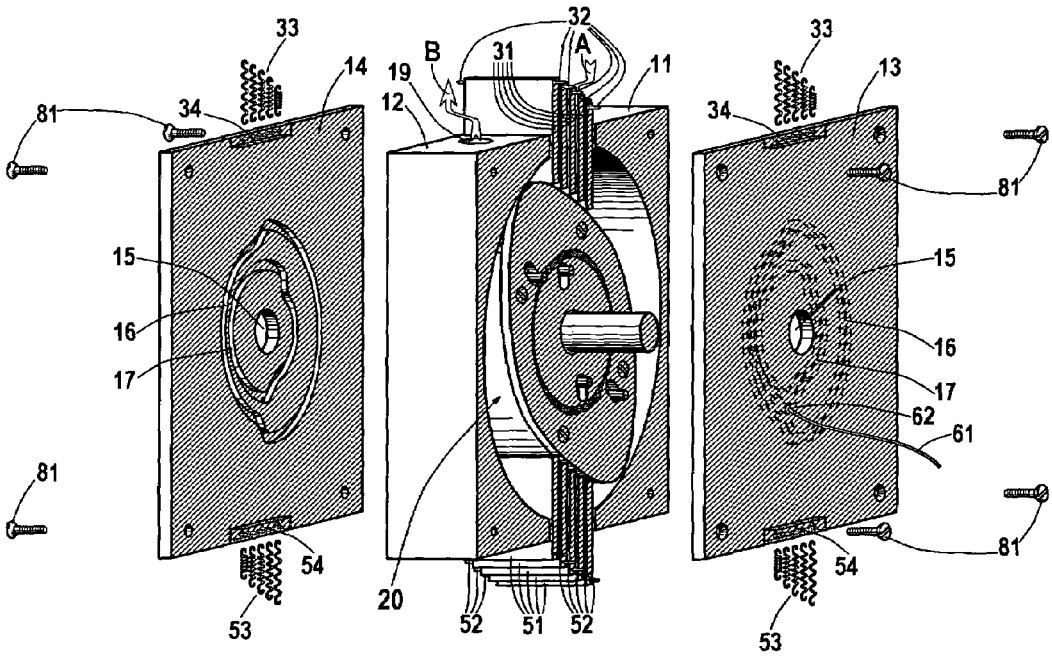
FIG. 2 shows an exploded perspective view of the engine.
Figure 3:
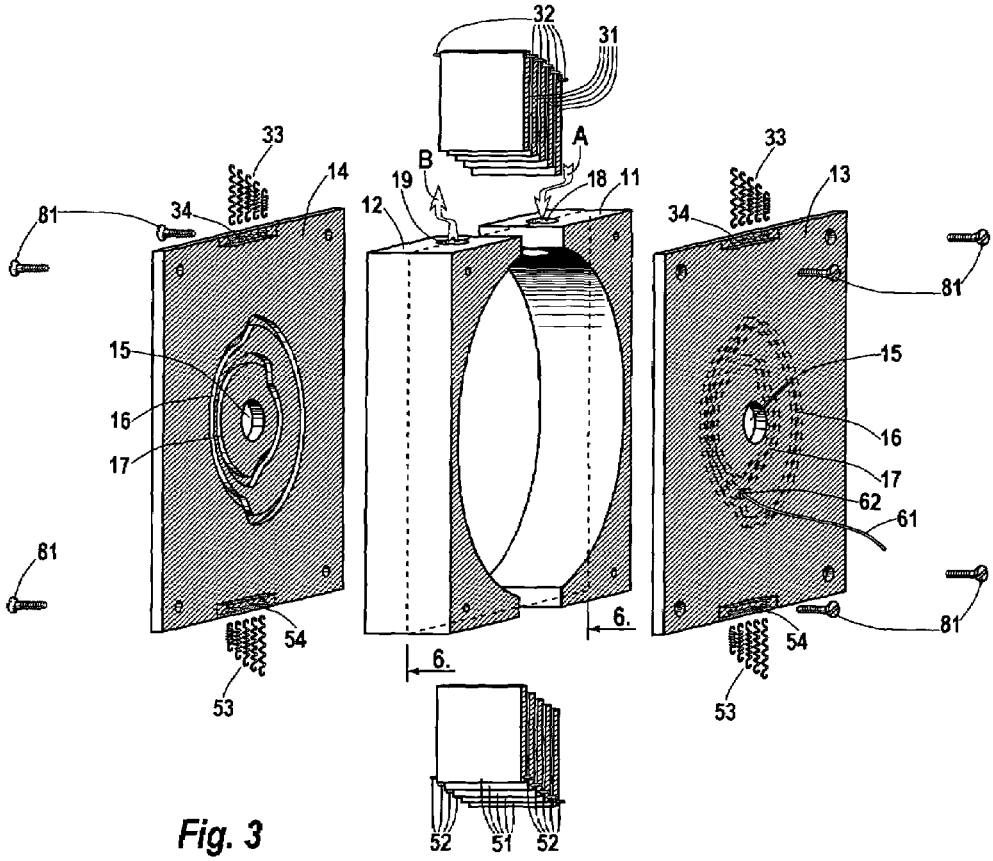
FIG. 3 shows an exploded perspective view of the engine's stator.
Figure 4:
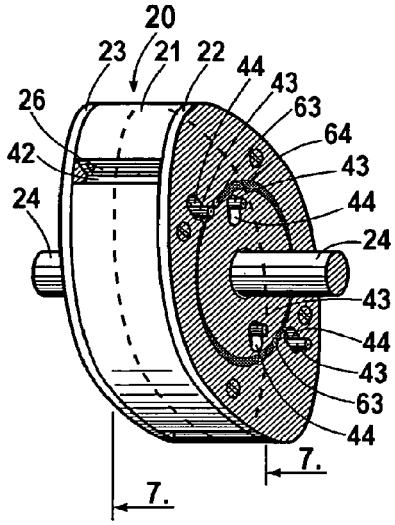
FIG. 4 shows a prospective view of the assembled engine's rotor.
Figure 5:
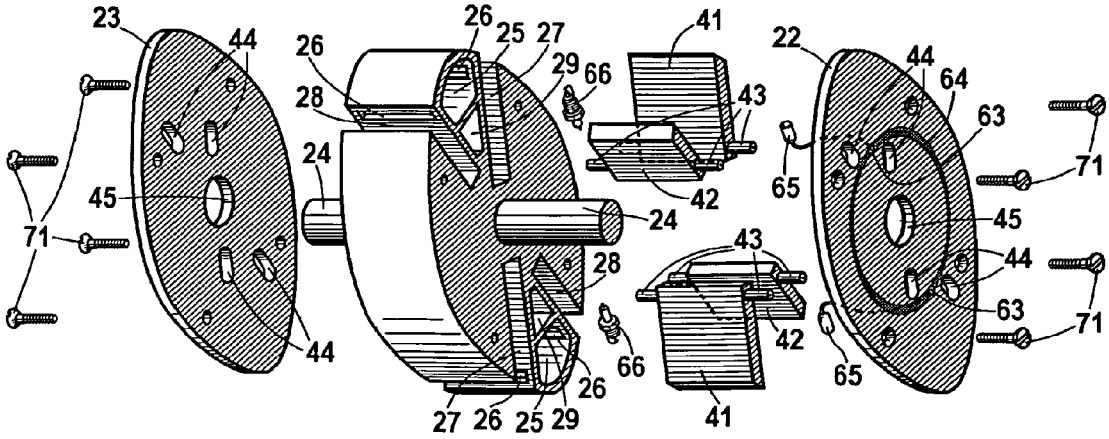
FIG. 5 shows an exploded perspective view of the engine's rotor.
Figure 6:
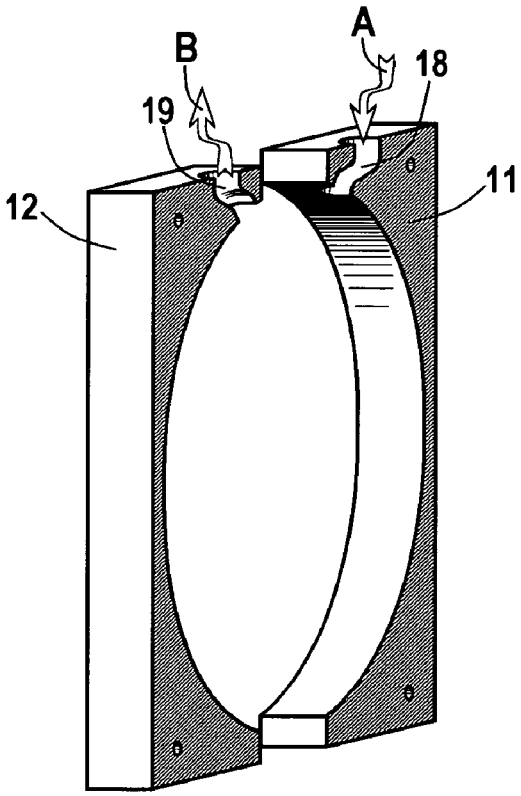
FIG. 6 shows a longitudinal section of the core halves of engine's stator taken in 6-6 plane in FIG. 3 in the area of the intake and exhaust orifices/conduits.
Figure 7:
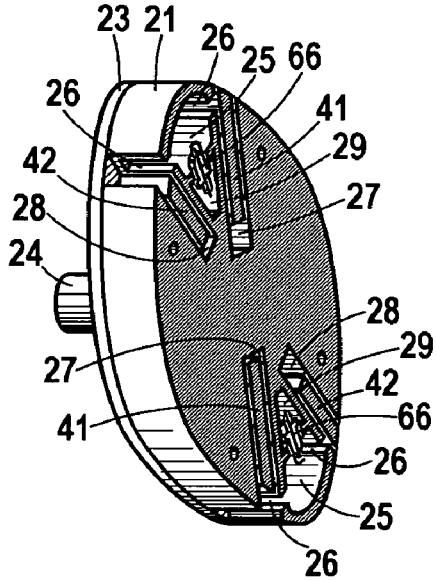
FIG. 7 shows a longitudinal section of the engine's rotor taken in 7-7 plane in FIG. 4 in the area of spark plugs.

The object of the invention is to create simple four cycle RICE with minimum parts that would provide smooth operation and high torque on engine rotor. The proposed technical solution presents unsurpassed advantages over prior arts in that: 1) it produces power stroke every 180°, 2) the power stroke coincides in phase with three other, passive strokes, i.e. intake, compression and exhaust thereby providing smooth, jerk-free revolution, as a single unit, 3) it does not require conventional valves and systems for their operation, 4) it does not require ignition timing system.

This object is attained in that in RICE comprising a right-prism rotor having rhombus-shape base with round angles and convex sides that accommodates two combustion chambers on opposite ends of a big diagonal of the rotor's base. The rotor being positioned in a hollow cylindrical body of a stator whose inner surface has the same diameter as the big diagonal of the rotor's base. This object is also attained in that the stator's hollow cylindrical core is provided with diametrically opposed and radially arranged space separators sealingly engaged with the surface of the rotor, which consist of several individual plates to ensure reliable pressurization by more precise contouring of the surface of the rotor. Combustion chambers are connected to other variable volume working chambers of the engine (i.e. intake, compression, power and exhaust) via a slot made along the rotor's height openings controlled by sliding covers that move within radial rectangular grooves in the rotor. Timely radial movements of the sliding covers during openings or closings of the slot openings are supported by a side lugs that move in a properly shaped guiding groves concentric with the whole system that are made within the stator side covers. Because the distance for radial movements of the sliding covers is small, the shape of the guiding grooves is minimally curved enabling high r.p.m. of the rotor. Fuel intake and exhaust of burned gasses are accomplished via respective conduits that do not require valves to operate.

One of possible solutions for the mechanism allowing sealing engagement of the space separators with the surface of the rotor, preventing leak of gasses between working chambers formed on both sides of the separators, is providing each constituent plate of the separator with individual springs that keep it pressed against the surface of the rotor.

The engine can be made and smoothly operate as a single unit. However, an assembly of several units is possible if justified by power requirements or a shift of operation angle among units is required to provide even smoother rotation.

In the simplest embodiment as a single unit one complete revolution of the rotor performs two complete cycles of a four-stroke engine.

PREFERRED EMBODIMENT—FIGS. 1-8

Major parts of the proposed invention are presented on FIG. 1, FIG. 2, FIG. 3, FIG. 4,. FIG. 5, FIG. 6, FIG. 7 and FIG. 8. A rotary internal combustion engine comprises a rotor 20 having a right prism body consisting of a core part 21 and two side lids 22 and 23, all sitting on a shaft 24. The base of the rotor has rhombus-like shape with round angles and convex sides, as depicted by thick solid line in FIG. 9. The core part of the rotor has two cavities on opposite ends of the big diagonal of the rotor's base forming combustion chambers 25. Each combustion chamber is flanked by two radial groves 27 and 28 made along whole height of the rotor's core. Each grove of the rotor's core houses a sliding cover 41 or 42 having a rectangular body whose height is smaller than the depth of the respective groove, length equals the height of the prism-like body of the rotor's core and width equals the width of the grove. The sliding covers can freely move in radial direction within the respective grove of the rotor's core thereby opening or closing slot openings 26 made along the rotor's height that connect upper part of the groves with the combustion chambers. To provide for radial movement of the sliding covers each of them is furnished with a side cylindrical lugs 43 that extend out of the rotor through an oblong radial openings 44 made within the rotor's side covers 22 and 23. Below each combustion chamber 25 a technological cavities 29 are made that serve for the insertion of a spark plugs 66 in such a way that they would extend into the combustion chambers. The side lids 22 and 23 have an opening 45 for the extension of the shaft of the rotor. The side cover 22 also has an annular insulating insert 64 concentric with the whole system, which serves to accommodate a two contacts 63 for the spark plugs. The contacts 63 connect to the spark plugs 66 by means of a high-voltage cables 65. The side lids 22 and 23 are fixed to the core part 21 accommodating the sliding covers 41, 42 and the spark plugs 66 with the help of screws 71.

The rotor 20 is mounted within a prism-shape stator 10 concentrically to its inner cylindrical surface having the same diameter as the big diagonal of the rotor's base with the help of two side cover lids 13 and 14 containing a concentric openings 15 for the rotor's shaft 24. The core part of the stator between the side cover lids 13 and 14 consists of two halves 11 and 12, which contain an intake 18 and an exhaust 19 conduits, respectively, and are cut in such a way that to provide diametrically opposed radial slots for accommodating a plates 31 and 51 of space separators 30 and 50, respectively. Each plate of the space separator is furnished with side pins 43 and 52 serving for fixing one end of springs 33 and 53, whose other end is attached to a special fastenings 34 and 54 on side cover lids 13 and 14. The surfaces of the side cover lids 13 and 14 that face the stator's interior have annular guiding grooves 16 and 17 into which the lugs 43 of the sliding covers 42 and 41, respectively, fit to enable radial motion of the sliding covers during rotation of the rotor 20. The shape of the guiding grooves has to be such, as to permit timely openings and closings of the slot openings 26 that lead to the combustion chambers 25 of the rotor. The side cover lid 13 also has an insulated contact 62 for igniting the spark plugs 66 connected to the source of high voltage through the cable 61. Whole assembly of the rotor 20, space separators 30 and 50, stator halves 11 and 12, lids 13 and 14 is secured by screws 81.

Figure 8:
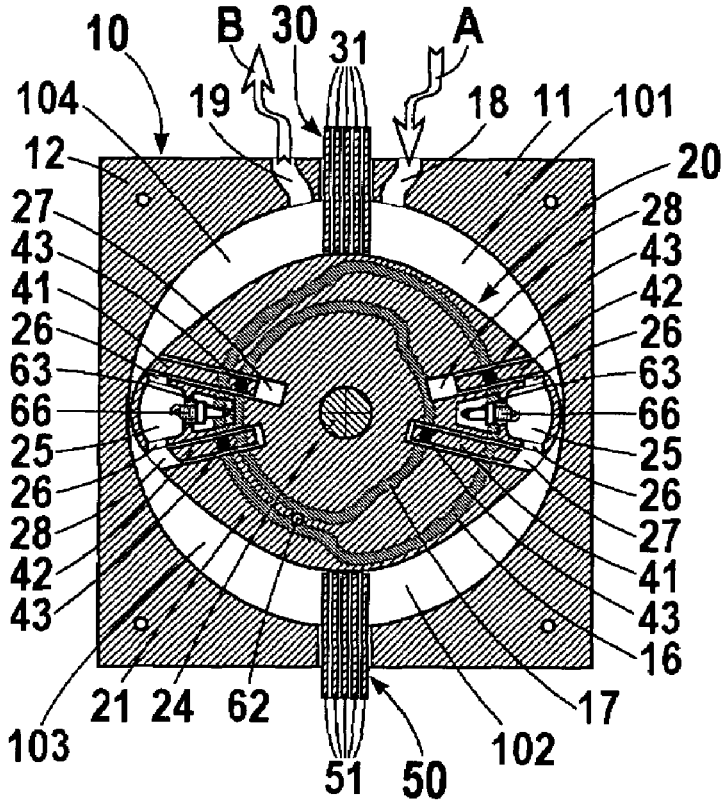
FIG. 8 is an enlarged diagrammatic cross sectional view taken through the middle of the engine with horizontal position of the rotor during the rotation. The guiding groves and the lugs for the sliding combustion chamber covers, as well as the ignition contacts are projected on the cross sectional view to better illustrate their relative disposition, whereas if shown as they appear in the drawings of FIGS. 2-5 no cross section would show all of them, and their simultaneous operation could not be seen. The guiding groves for the sliding combustion chamber covers are illustrated with closely spaced hatching.
Figure 9:
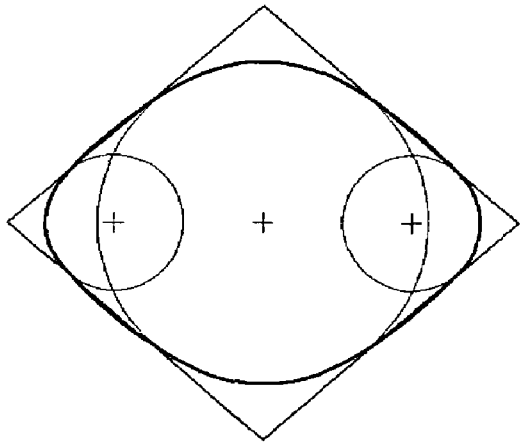
FIG. 9 shows geometrical shape of the base of the engine's rotor.
Figure 10:
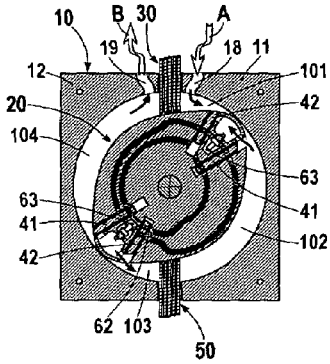
FIGS. 10-18 show similar cross sectional view to that of FIG. 8, but corresponding to the different positions of engine parts during one complete cycle of a four-stroke engine at 180° revolution of the rotor. The arrows inside the engine show gas flows during operation.
Figure 11:
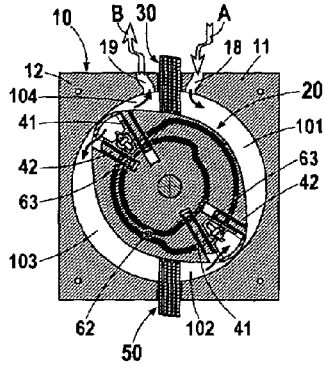
Figure 12:
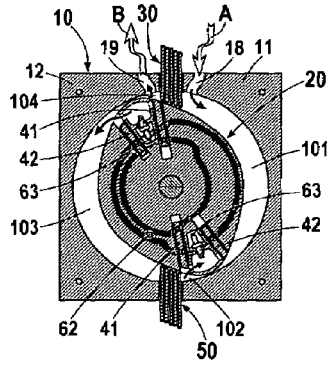
Figure 13:
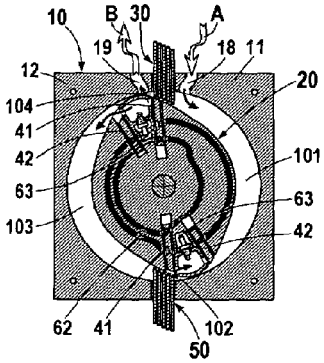

Inner surface of the stator 10, outer surface of the rotor 20 and the side surfaces of the space separators 30 and 50 form four variable volume working chambers of the engine—an intake chamber 101, a compression chamber 102, a power chamber 103 and an exhaust chamber 104 (FIG. 8). The volume of each chamber changes from zero to half of the total space between the inner surface of the stator 10 and the outer surface of the rotor 20 during rotor's rotation.

Operation of Invention—FIG. 8, FIGS. 10-18

The two diametrically opposite combustion chambers 25 of the rotor 20 are indistinguishable in terms of engine operation, and their function is determined only by the position of the rotor. Therefore, we did not assign separate numbers to them while describing invention's operation.

The engine operates in the consecutive steps presented in FIGS. 10-18.

We examine engine's operation from the starting position of the rotor 20 (FIG. 6) just after the compressed gasses in the combustion chamber located to the left of the space separators 30 and 50 were ignited, and the expanding gasses that exit this chamber though the slot opening controlled by the sliding cover 42 into the power chamber 103 drive clockwise rotation of the rotor. In this position of the rotor the sliding cover 41 of the same combustion chamber is closed, whilst the sliding covers 41 and 42 of the diametrically opposite combustion chamber are in open and closed positions, respectively. In the same starting position: 1) the volume of the intake chamber 101 is close to minimal, and it is open to the intake conduit 18; 2) the compression chamber 102 is filled with the air-fuel mixture, its volume is close to maximal, and it is open to the combustion chamber located to the right of the space separators 30 and 50; 3) the power chamber 103 is filled with the expanding combusted gasses, its volume is close to minimal, and it is open to the combustion chamber located to the left of the space separators 30 and 50; 4) the exhaust chamber 104 is filled with the burned gasses, its volume is close to maximal, and it is open to the exhaust conduit 19. During clockwise rotation the rotor 20: 1) the volume of the power chamber 103 increases due to the expansion of combusted gasses; 2) the volume of the intake chamber 101 increases sucking in the air-fuel mixture from the intake conduit 18; 3) the volume of the compression chamber 102 decreases driving air-fuel mixture into the combustion chamber located to the right of the space separators 30 and 50; 4) the volume of the exhaust chamber 104 decreases driving burned gasses into the exhaust system via the exhaust conduit 19.

Figure 14:
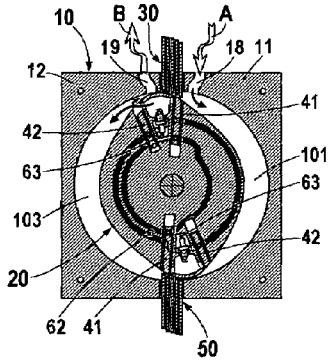
Figure 15:
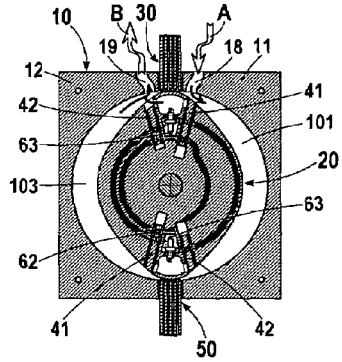
Figure 16:
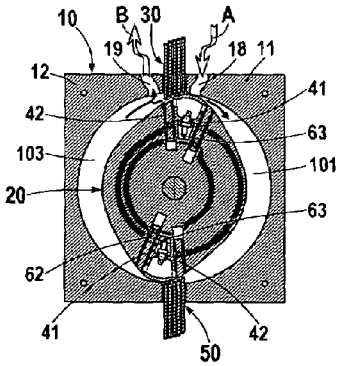
Figure 17:
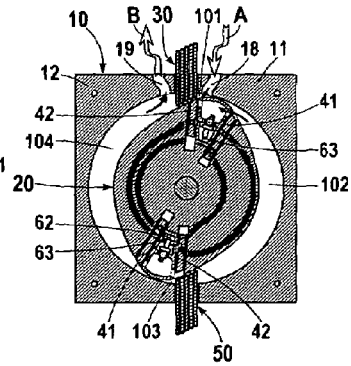
Figure 18:
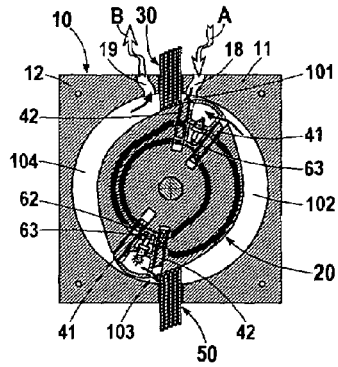

When the combustion chamber, which is located to the right of the space separators 30 and 50, during clockwise rotation of the rotor 20 approaches the space separator 50, the sliding cover 41 of the same combustion chamber starts closing the slot opening that it controls (FIGS. 12-14) completely locking compressed air-fuel mixture within this combustion chamber upon exiting from underneath the space separator 50 (FIG. 14). When the sliding cover 42 of this combustion chamber enters the space underneath the space separator 50 (FIG. 16) it starts opening the slot opening that it controls permitting leak of compressed air-fuel mixture into the power chamber 103 upon exiting from underneath the space separator 50 (FIG. 17). When combustion chamber becomes nearly completely opened into the power chamber 103 the contact 63 for the spark plug coincides with the contact 62 for the high voltage, which causes the ignition of the compressed air-fuel mixture in the combustion chamber (FIG. 18). Expanding combusted gases exit through the slot opening controlled by the sliding cover 42 into the power chamber 103 and apply force to the combustion chamber's interior providing thereby the torque to the rotor 20 in the clockwise direction. The process then repeats from the stage of FIG. 10.

In the meantime, when the slot opening controlled by the sliding cover 42 of the combustion chamber, which is located to the left of the space separators 30 and 50, passes by the exhaust conduit 19 the sliding cover 42 of this combustion chamber starts closing (FIG. 15), which completes upon exiting from underneath the space separator 30 (FIG. 17). Simultaneously, the sliding cover 41 of this combustion chamber starts opening the slot opening that it controls allowing the air-fuel mixture from the compression chamber 102 to be driven into the combustion chamber (FIG. 17 and FIG. 18). The process then repeats from the stage of FIG. 10.

ALTERNATIVE EMBODIMENTS

The proposed engine's embodiment is optimal for providing smooth and effective operation.

CONCLUSION, RAMIFICATIONS, AND SCOPE OF INVENTION

Thus the reader will see that the RICE of the invention has simple design with minimum parts and accessory systems for operation ensuring low cost of production, and provides the most effective interaction of expanding gases with the rotor generating thereby high torque.

The unsurpassed advantages of proposed engine listed above combined with compact design and lack for the necessity of substantial auxiliary systems for its operation can lead to the revision of the whole concept of motor vehicles design: separate engine can power each wheel or a pair of wheels reducing or even eliminating the transmission system and the energy losses associated with it. The engine can also perfectly combine with electric motors in the hybrid configurations.

While my above description contains many specificities, these should not be construed as limitations on the scope of the invention, but rather as an exemplification of one preferred embodiment thereof This especially relates to the design of the system providing tight contouring of the rotor's surface by the space separators 30 and 50. For example, instead of the springs 33 and 53 that keep the plates 31 and 51 of the separators passively pressed against the surface of the rotor the plates can be provided with the mechanism of forcible engagement with the surface of the rotor.

Accordingly, the scope of the invention should be determined not by the embodiment(s) illustrated, but by the appended claims and their legal equivalents.

What I claim as my invention is:

1. A four-cycle, rotary internal combustion engine with rotating combustion chambers, comprising:

two side cover lids;

a hollow stator with inner cylindrical surface; and a rotor having a right-prism body of the same height as of said stator and a rhombus-shape base with round angles and convex sides whose big diagonal equals the diameter of the hollow core of said stator;

wherein said rotor further comprising:

two combustion chambers located on opposite ends of the big diagonal of rhombus-shape base of said rotor;

a spark plug being disposed in each of said combustion chambers;

a source of high voltage being timely connected to said spark plug during rotation of said rotor to ignite air-fuel mixture within each of said combustion chambers;

two radial rectangular grooves being flanking said combustion chambers along a whole height of the rotor;

slot openings the height of said rotor, wherein each of said combustion chambers connects to the uppermost part of said radial rectangular grooves via said slot openings;

sliding covers having a rectangular body with the same height as of said rotor and being positioned in said radial rectangular grooves flanking said combustion chambers of said rotor;

wherein said sliding covers are provided with a means of moving in a radial direction within said radial rectangular grooves of said rotor opening and closing said slot openings of said combustion chambers; and wherein said rotor is positioned in said stator concentrically to said inner cylindrical surface forming the hollow core thereof, and said two side cover lids of said stator.

2. The rotary internal combustion engine with rotating combustion chambers, as claimed in claim 1, further comprising:

a two diametrically opposed radial slots within said stator along the stator whole height;

wherein said radial slots accommodate space separators;

wherein said space separators consist of individual plates having a rectangular body with the same height as of said stator; and wherein said space separators are provided with a means of sealing engagement with an outer surface of said rotor.

3. The rotary internal combustion engine with rotating combustion chambers, as claimed in claim 2, wherein said inner cylindrical surface of said stator, said outer surface of said rotor and side surfaces of said space separators form a variable volume intake, compression, power and exhaust chambers;

wherein said intake chamber connects to an intake conduit within said stator, said exhaust chamber connects to an exhaust conduit within said stator and said compression and exhaust chambers connect to said combustion chambers via said slot openings.

* * * * *